US008913939B2

(12) United States Patent
Fujihara

(10) Patent No.: US 8,913,939 B2
(45) Date of Patent: Dec. 16, 2014

(54) PRESSING MEMBER FOR FIXING, FIXING DEVICE, AND IMAGE-FORMING APPARATUS

(75) Inventor: Issei Fujihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 117 days.

(21) Appl. No.: 13/616,351

(22) Filed: Sep. 14, 2012

(65) Prior Publication Data

US 2013/0251427 A1 Sep. 26, 2013

(30) Foreign Application Priority Data

Mar. 26, 2012 (JP) ..... 2012-069962

(51) Int. Cl.
*G03G 15/20* (2006.01)

(52) U.S. Cl.
CPC ..... *G03G 15/2053* (2013.01); *G03G 15/2089* (2013.01)
USPC ..... 399/333; 399/331

(58) Field of Classification Search
CPC ..... G03G 15/20
USPC ..... 399/333, 331
See application file for complete search history.

(56) References Cited

U.S. PATENT DOCUMENTS

| | | | | |
|---|---|---|---|---|
| 5,217,532 | A * | 6/1993 | Sasame et al. | 118/60 |
| 5,520,600 | A * | 5/1996 | Fukumoto | 492/56 |
| 7,585,169 | B2 * | 9/2009 | Jahn et al. | 425/362 |
| 8,301,068 | B2 * | 10/2012 | Kondoh et al. | 399/333 |
| 2005/0163541 | A1 * | 7/2005 | Aramata et al. | 399/328 |
| 2006/0216078 | A1 * | 9/2006 | Higashi et al. | 399/333 |
| 2008/0031663 | A1 * | 2/2008 | Ohhara et al. | 399/333 |
| 2011/0182638 | A1 * | 7/2011 | Ishii et al. | 399/333 |
| 2013/0251426 | A1 * | 9/2013 | Omata | 399/333 |
| 2013/0251427 | A1 * | 9/2013 | Fujihara | 399/333 |

FOREIGN PATENT DOCUMENTS

| | | | | |
|---|---|---|---|---|
| JP | 2-150876 A | | 6/1990 | |
| JP | 1990-150876 | * | 6/1990 | G03G 15/20 |
| JP | 2004-102231 A | | 4/2004 | |
| JP | 2004-102232 A | | 4/2004 | |
| JP | 2008-003265 | * | 1/2008 | G03G 15/20 |
| JP | 2008-3265 A | | 1/2008 | |
| JP | 2008-158332 A | | 7/2008 | |

* cited by examiner

*Primary Examiner* — Clayton E LaBalle
*Assistant Examiner* — Kevin Butler
(74) *Attorney, Agent, or Firm* — Sughrue Mion, PLLC

(57) ABSTRACT

A pressing member for fixing includes a substantially cylindrical substrate; a first layer that is disposed on an outer surface of the substrate, that contains bubbles, and that is elastic; a second layer disposed on an outer surface of the first layer; and an adhesive layer bonding together the first layer and the second layer. The pressing member has an adhesive-free unbonded region between the first layer and the second layer. The unbonded region extends to at least one end of the pressing member in an axial direction.

18 Claims, 7 Drawing Sheets

PRESSING MEMBER FOR FIXING, FIXING DEVICE, AND IMAGE-FORMING APPARATUS

CROSS-REFERENCE TO RELATED APPLICATIONS

This application is based on and claims priority under 35 USC 119 from Japanese Patent Application No. 2012-069962 filed Mar. 26, 2012.

BACKGROUND (i) Technical Field

The present invention relates to pressing members for fixing, fixing devices, and image-forming apparatuses.

(ii) Related Art

One method for fixing toner images in electrophotographic image-forming apparatuses involves the use of a heating member that is heated by a heat source and a pressing member having an elastic layer on the outer surface thereof. The elastic layer is formed of a material such as a rubber containing bubbles. This method presses the pressing member against the heating member, which is being rotated, to deform the elastic layer on the pressing member. As a result, a contact area having a certain width in the circumferential direction of the pressing member is formed. A recording medium having a toner image formed thereon is advanced through the contact area to melt and press the toner image, thereby fixing it to the recording medium.

SUMMARY

According to an aspect of the invention, there is provided a pressing member for fixing including a substantially cylindrical substrate; a first layer that is disposed on an outer surface of the substrate, that contains bubbles, and that is elastic; a second layer disposed on an outer surface of the first layer; and an adhesive layer bonding together the first layer and the second layer. The pressing member has an adhesive-free unbonded region between the first layer and the second layer. The unbonded region extends to at least one end of the pressing member in an axial direction.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereinafter be described with reference to the drawings.

Image-Forming Apparatus

Figure 1:
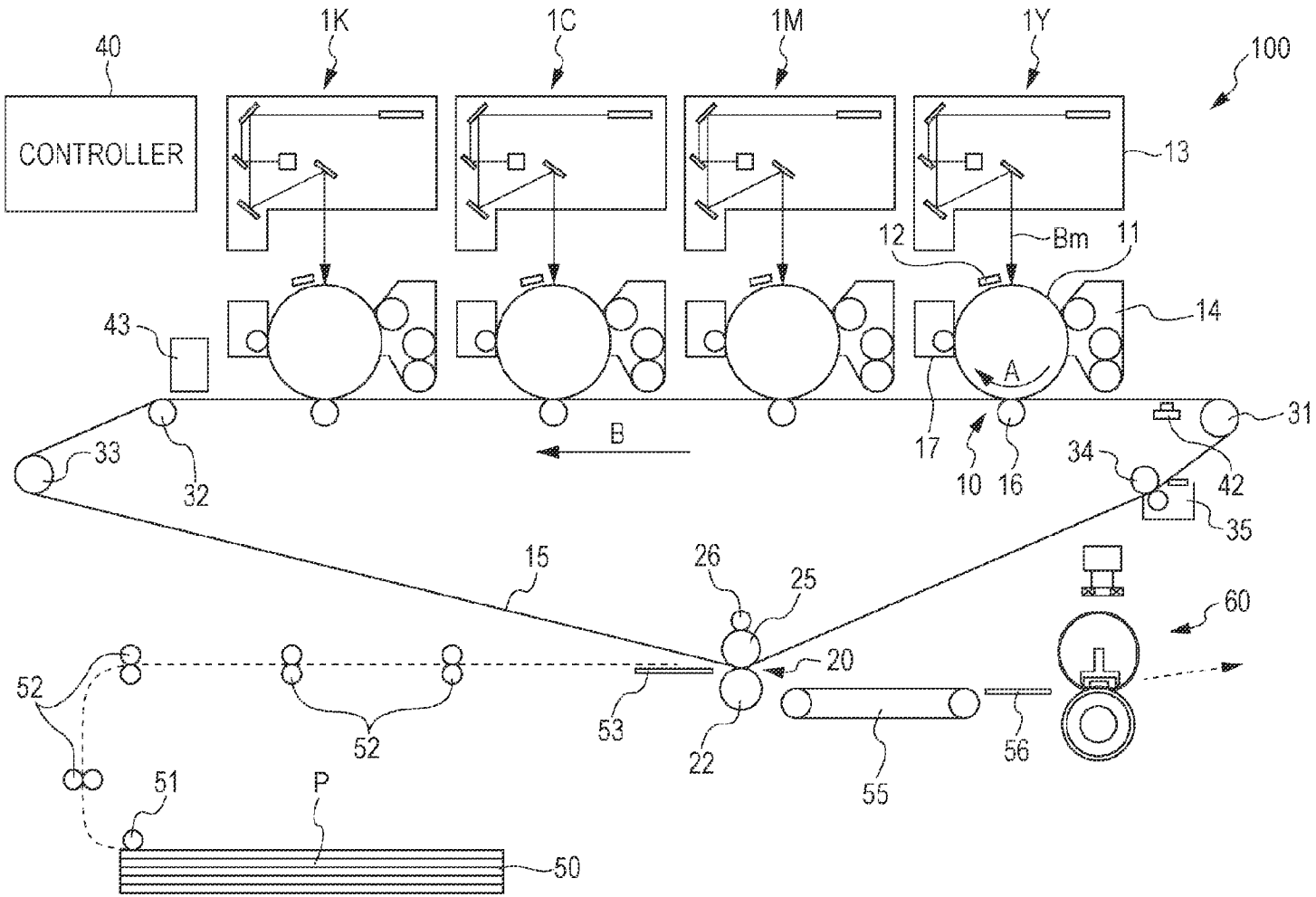
FIG. 1 is a schematic view of an image-forming apparatus according to an exemplary embodiment.

FIG. 1 is a schematic view of an image-forming apparatus according to an exemplary embodiment of the present invention.

An image-forming apparatus 100 illustrated in FIG. 1 is an intermediate transfer printer. The image-forming apparatus 100 includes yellow (Y), magenta (M), cyan (C), and black (K) image-forming units 1Y, 1M, 1C, and 1K, first transfer units 10, a second transfer unit 20, and a fixing device 60. The image-forming units 1Y, 1M, 1C, and 1K electrophotographically form toner images of the respective colors. The first transfer units 10 sequentially transfer the toner images from the image-forming units 1Y, 1M, 1C, and 1K to an intermediate transfer belt 15 (i.e., first transfer). The second transfer unit 20 simultaneously transfers the superimposed toner image from the intermediate transfer belt 15 to paper P (i.e., second transfer). The paper P corresponds to an example of a recording medium. The fixing device 60 fixes the toner image to the paper P. The image-forming apparatus 100 also includes a controller 40 that controls the operations of the individual devices and units. The image-forming units 1Y, 1M, 1C, and 1K, the intermediate transfer belt 15, the first transfer units 10, and the second transfer unit 20 correspond to an example of a toner-image forming section in this exemplary embodiment.

The image-forming apparatus 100 is a tandem printer in which the image-forming units 1Y, 1M, 1C, and 1K are arranged in parallel in the above order from upstream of the intermediate transfer belt 15. The image-forming units 1Y, 1M, 1C, and 1K are identical to each other except that they use toners of different colors.

The description herein will focus on the yellow image-forming unit 1Y, the components of which are provided with reference numerals. The image-forming unit 1Y includes a photoreceptor drum 11, a charging device 12, a laser exposure device 13, a developing device 14, the first transfer unit 10, and a drum cleaner 17. The photoreceptor drum 11 rotates in the direction indicated by the arrow A. The charging device 12 charges the photoreceptor drum 11. The laser exposure device 13 irradiates the photoreceptor drum 11 with an exposure beam Bm to write an electrostatic latent image. The developing device 14 contains a yellow toner and develops the electrostatic latent image on the photoreceptor drum 11 with the toner. The first transfer unit 10 transfers the toner image from the photoreceptor drum 11 to the intermediate transfer belt 15. The drum cleaner 17 removes residual toner from the photoreceptor drum 11.

The intermediate transfer belt 15 is, for example, a film-shaped endless belt formed of a resin containing an antistatic agent. The intermediate transfer belt 15 is entrained about rollers and rotates in the direction indicated by the arrow B in FIG. 1. The rollers about which the intermediate transfer belt 15 is entrained include a drive roller 31, a support roller 32, a tension roller 33, a backup roller 25, and a cleaner backup roller 34. The drive roller 31 drives the intermediate transfer belt 15. The support roller 32 supports both ends of the region of the intermediate transfer belt 15 extending along the arrangement of the photoreceptor drums 11. The tension roller 33 applies a predetermined tension to the intermediate transfer belt 15. The backup roller 25 is provided in the second transfer unit 20. The cleaner backup roller 34 is provided in a cleaning unit. As the drive roller 31 is driven by a motor (not shown), the intermediate transfer belt 15 is rotated at a predetermined speed. The tension roller 33 also functions as a straightening roller that prevents the intermediate transfer belt 15 from meandering.

The first transfer unit 10 includes a first transfer roller 16 disposed opposite the photoreceptor drum 11 with the intermediate transfer belt 15 therebetween. The intermediate transfer belt 15 is nipped between the first transfer roller 16 and the photoreceptor drum 11. The first transfer roller 16 is supplied with a voltage (first transfer bias) of opposite polarity to the toner (in this example, the toner is negatively charged, which will apply hereinafter).

The second transfer unit 20 includes a second transfer roller 22, the backup roller 25, and a power supply roller 26. The second transfer roller 22 is disposed opposite the surface of the intermediate transfer belt 15 on which a toner image is carried. The power supply roller 26 applies a second transfer bias to the backup roller 25. The backup roller 25 is disposed opposite the inner surface of the intermediate transfer belt 15, i.e., opposite the second transfer roller 22 with the intermediate transfer belt 15 therebetween. The backup roller 25 functions as a counter electrode for the second transfer roller 22. An image density sensor 43 is disposed downstream of the black image-forming unit 1K for image quality control.

An intermediate transfer belt cleaner 35 is disposed on the intermediate transfer belt 15 downstream of the second transfer unit 20. The intermediate transfer belt cleaner 35 cleans the surface of the intermediate transfer belt 15 by removing residual toner and paper dust from the intermediate transfer belt 15 after second transfer. A reference sensor (home position sensor) 42 is disposed upstream of the yellow image-forming unit 1Y. The reference sensor 42 generates a reference signal to provide timing for image formation in the image-forming units 1Y, 1M, 1C, and 1K.

The image-forming apparatus 100 includes a paper transport system including a paper container 50, a feed roller 51, transport rollers 52, a guide member 53, a transport belt 55, and a fixing entrance guide 56. The paper container 50 contains the paper P. The feed roller 51 feeds the paper P from the paper container 50. The transport rollers 52 transport the paper P. The guide member 53 guides the paper P transported by the transport rollers 52 to the second transfer unit 20. The transport belt 55 transports the paper P from the second transfer roller 22 to the fixing device 60 after second transfer. The fixing entrance guide 56 guides the paper P to the fixing device 60. The transport belt 55 and the fixing entrance guide 56 correspond to an example of a transport device in this exemplary embodiment.

Figure 2:
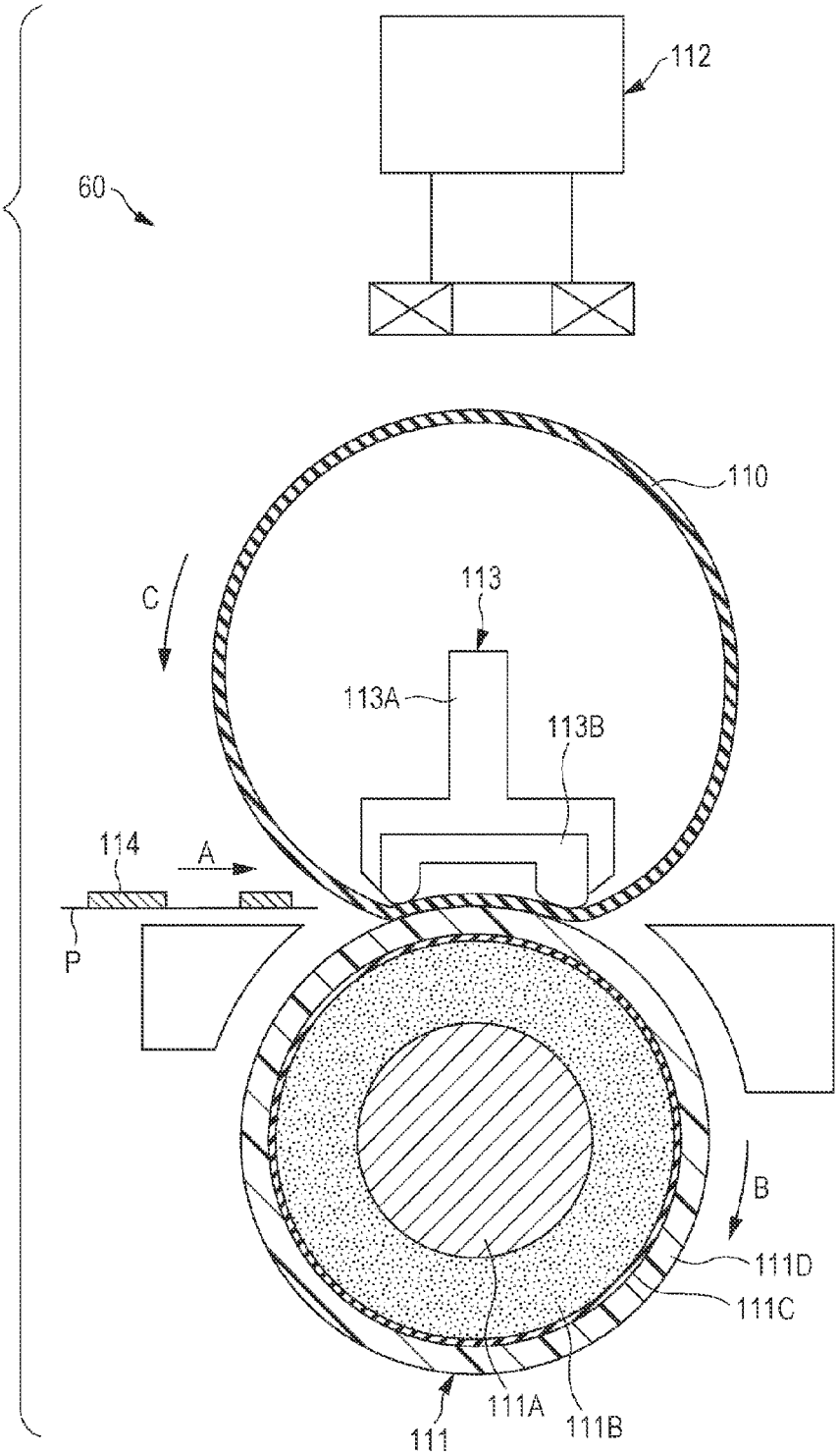
FIG. 2 is a sectional view illustrating the structure of a fixing device illustrated in FIG. 1.

As illustrated in FIG. 2, the fixing device 60 includes a pressing roller 111 and a heat-fixing belt 110. The pressing roller 111 is rotated by a drive unit (not shown). The heat-fixing belt 110 is rotated together with the pressing roller 111. The pressing roller 111 and the heat-fixing belt 110 heat and press the paper P therebetween to fix the unfixed toner image to the paper P. The structure of the fixing device 60 will be described in greater detail later.

The basic process of the image-forming apparatus 100 will now be described.

The image-forming apparatus 100 processes image data fed from an image reader or personal computer (PC) (not shown), converts the image data into colorant gradation data for the four colors, namely, Y, M, C, K, and feeds the colorant gradation data to the laser exposure devices 13 of the image-forming units 1Y, 1M, 1C, and 1K. Based on the colorant gradation data, the laser exposure devices 13 irradiate the photoreceptor drums 11 of the image-forming units 1Y, 1M, 1C, and 1K with the exposure beam Bm, which is emitted from, for example, a semiconductor laser. After the charging devices 12 of the image-forming units 1Y, 1M, 1C, and 1K charge the surfaces of the photoreceptor drums 11, the laser exposure devices 13 expose the surfaces of the photoreceptor drums 11 by scanning the exposure beam Bm thereacross to form electrostatic latent images. The electrostatic latent images are developed as toner images of the respective colors by the developing devices 14 of the image-forming units 1Y, 1M, 1C, and 1K.

The toner images formed on the photoreceptor drums 11 of the image-forming units 1Y, 1M, 1C, and 1K are sequentially transferred to and superimposed on the surface of the intermediate transfer belt 15 by the first transfer units 10. After the toner images are sequentially transferred to the surface of the intermediate transfer belt 15, the intermediate transfer belt 15 is moved to transport the superimposed toner image from the surface of the intermediate transfer belt 15 to the second transfer unit 20. At the same time, the feed roller 51 of the paper transport system feeds the paper P from the paper container 50 in accordance with the timing when the toner image is transported to the second transfer unit 20. The paper P fed by the feed roller 51 is transported to the second transfer unit 20 by the transport rollers 52 in accordance with the timing when the intermediate transfer belt 15 carrying the toner image is moved.

The second transfer unit 20 transfers the toner image from the intermediate transfer belt 15 to the paper P nipped between the intermediate transfer belt 15 and the second transfer roller 22. The paper P having the toner image electrostatically transferred thereto is transported to the fixing device 60 by the transport belt 55. The fixing device 60 applies heat and pressure to the toner image on the paper P to fix it to the paper P. The paper P having the image fixed thereto is ejected to an eject section (not shown).

After the second transfer unit 20 transfers the toner image from the intermediate transfer belt 15 to the paper P, the intermediate transfer belt cleaner 35 removes residual toner from the intermediate transfer belt 15.

Fixing Device

The fixing device 60 of the image-forming apparatus 100 illustrated in FIG. 1 will now be described. The fixing device 60 is a fixing device according to an exemplary embodiment of the present invention.

FIG. 2 is a sectional view illustrating the structure of the fixing device 60 illustrated in FIG. 1.

The fixing device 60 is an induction-heating fixing device 60. The fixing device 60 includes a housing accommodating the heat-fixing belt 110, a pressure member 113 including a pressure pad 113B and a holder 113A, the pressing roller 111, and a magnetic field generator 112.

The pressing roller 111 corresponds to an example of a pressing member in this exemplary embodiment. The heat-fixing belt 110 corresponds to an example of a heat-fixing member in this exemplary embodiment. The magnetic field generator 112 corresponds to an example of a heating device in this exemplary embodiment.

As illustrated in FIG. 2, the heat-fixing belt 110 is held between the bottom surface of the pressure member 113 and the outer surface of the pressing roller 111. The pressing roller 111 includes a core 111A supported at both ends by bearings such that the pressing roller 111 is free to rotate. An upward force exerted on the bearings by springs presses the outer surface of the pressing roller 111 against the bottom surface of the pressure member 113 with the heat-fixing belt 110 therebetween. The pressing roller 111 also includes an elastic layer 111B and a release layer 111D that are elastically deformable. As illustrated in FIG. 2, therefore, a contact area having a certain width in the circumferential direction of the pressing roller 111 is formed between the heat-fixing belt 110 and the pressing roller 111.

The pressing roller 111 is rotated by a drive unit in the direction indicated by the arrow B in FIG. 2. As the pressing roller 111 is rotated, friction acting on the outer surface of the heat-fixing belt 110 causes the inner surface of the heat-fixing belt 110 to move in the direction indicated by the arrow C while rubbing the bottom surface of the pressure member 113.

To reduce the friction between the bottom surface of the pressure member 113 and the inner surface of the heat-fixing belt 110, a lubricant such as a heat-resistant grease may be applied between the bottom surface of the pressure member 113 and the inner surface of the heat-fixing belt 110.

The magnetic field generator 112 generates an alternating magnetic flux for generating heat from a heat-generating layer, described later, of the heat-fixing belt 110. The magnetic field generator 112 includes an exciting circuit, a magnetic core, an exciting coil, and an exciting coil holder.

The magnetic core is formed of a material with high permeability, such as ferrite or permalloy. The exciting circuit generates an alternating current with a frequency of from 20 to 500 kHz. The exciting coil is supplied with the alternating current from the exciting circuit to generate an alternating magnetic flux. The exciting coil is formed by, for example, repeatedly winding a bundle of copper wires coated with an insulator.

The magnetic core and the exciting coil are formed along the outer surface of the heat-fixing belt 110, which is held in a cylindrical shape. In this exemplary embodiment, the distance between the outer surface of the heat-fixing belt 110 and the exciting coil is set to 2 mm.

The pressure member 113 is assembled by attaching the pressure pad 113B to the holder 113A. The pressure pad 113B is formed of, for example, silicone rubber. In this exemplary embodiment, the silicone rubber has a hardness of 20° (JIS-A hardness (Japanese Industrial Standards)). The holder 113A is formed of, for example, a metal such as stainless steel or a heat-resistant synthetic resin.

Figure 3:
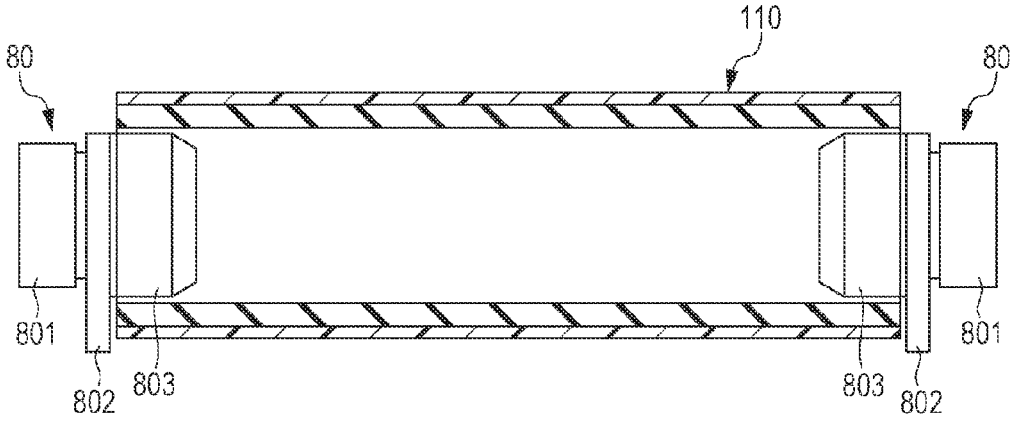
FIG. 3 is a sectional view of a heat-fixing belt illustrated in FIG. 2 as viewed in a paper transport direction.

FIG. 3 is a sectional view of the heat-fixing belt 110 illustrated in FIG. 2 as viewed in the paper transport direction. As illustrated in FIG. 3, end stop members 80 are disposed at both ends of the heat-fixing belt 110. The end stop members 80 each include a cylindrical portion 803, a flange 802, and a holding portion 801. The cylindrical portions 803 have an outer diameter smaller than the inner diameter of the heat-fixing belt 110 as held in a cylindrical shape. The flanges 802 have an outer diameter larger than the outer diameter of the heat-fixing belt 110 held by the cylindrical portions 803. The flanges 802 abut both ends of the heat-fixing belt 110, which may prevent the heat-fixing belt 110 from meandering. The holding portions 801, disposed outside the flanges 802, are fixed to the housing.

The heat-fixing belt 110 is an endless belt having a layered structure including, in order from the inside, a substrate layer, a heat-generating layer, an elastic layer, and a release layer.

The substrate layer is formed of a heat-resistant resin and has a thickness of, for example, from 10 to 100 μm. Examples of resins include polyester, polyethylene terephthalate, polyethersulfone, polyetherketone, polysulfone, polyimide, polyamideimide, and polyamide. In this exemplary embodiment, a polyimide film having a thickness of 50 μm is used.

The heat-generating layer is formed of a metal such as iron, cobalt, nickel, copper, or chromium and has a thickness of, for example, from 1 to 50 μm. The heat-generating layer may be made thinner so that the heat-fixing belt 110 deforms along the shape of the pressure member 113. In this exemplary embodiment, the heat-generating layer is formed by plating the substrate layer with copper, which has high conductivity, to a thickness of 10 μm for improved heat generation efficiency.

The elastic layer is formed of a material with high heat resistance and thermal conductivity, such as silicone rubber, fluorocarbon rubber, or fluorosilicone rubber. The elastic layer preferably has a thickness of from 10 to 500 μm, more preferably from 50 to 500 μm. In this exemplary embodiment, the elastic layer has a thickness of 300 μm.

The elastic layer preferably has a hardness of 60° or less, more preferably 45° or less (JIS-A hardness, measured by a JIS-K type A durometer).

The release layer may be formed of a material with high releasability and heat resistance, such as fluorocarbon resin (e.g., perfluoroalkoxy (PFA), polytetrafluoroethylene (PTFE), or fluorinated ethylene propylene (FEP)), silicone resin, silicone rubber, or fluorocarbon rubber. The release layer may have a thickness of from 20 to 100 μm. In this exemplary embodiment, the release layer has a thickness of 30 μm.

The heat-fixing belt 110 generates heat from the heat-generating layer when an alternating magnetic flux generated by the exciting coil of the magnetic field generator 112 causes eddy currents in the heat-generating layer. In the contact area between the heat-fixing belt 110 and the pressing roller 111, the heat generated from the heat-generating layer is transferred through the elastic layer and the release layer of the heat-fixing belt 110 to a toner image 114 formed on the paper P to fix the toner image 114.

Pressuring Member

The pressing roller 111, which corresponds to an example of a pressing member, of the fixing device 60 illustrated in FIG. 2 will now be described.

Figure 4:
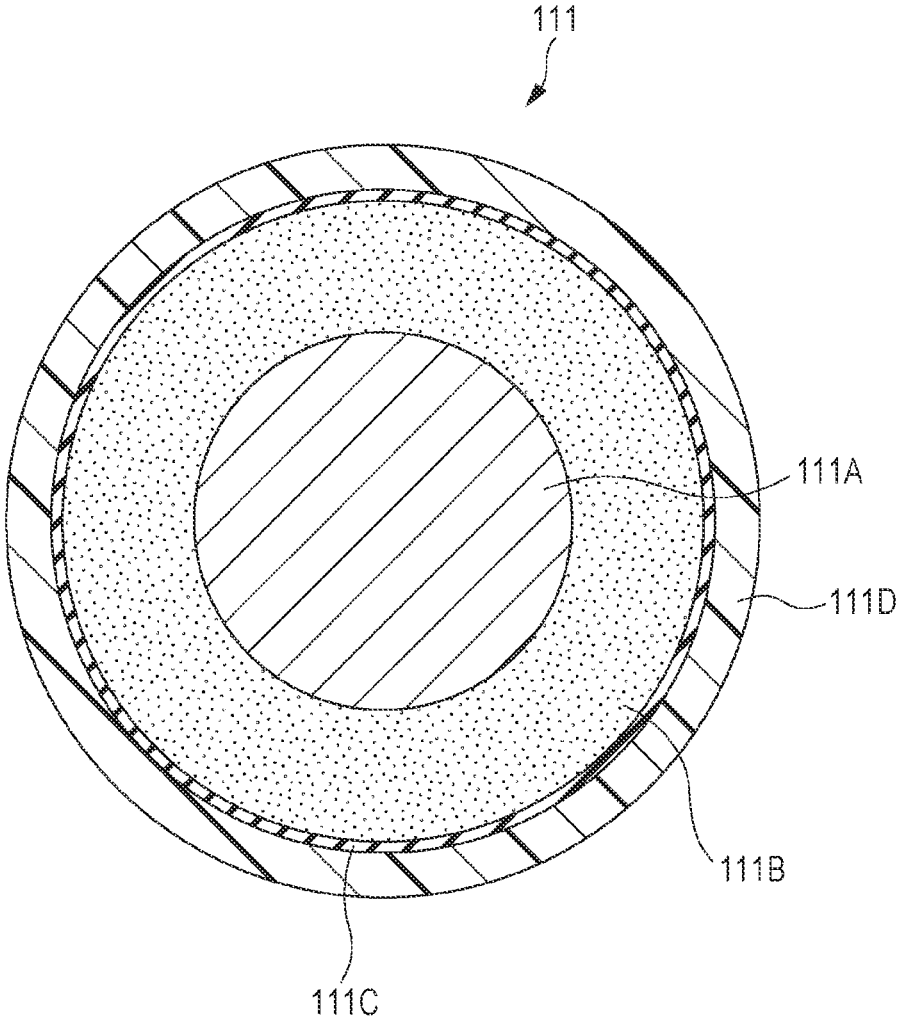
FIG. 4 is a sectional view of a pressing roller according to the exemplary embodiment.
Figure 5:
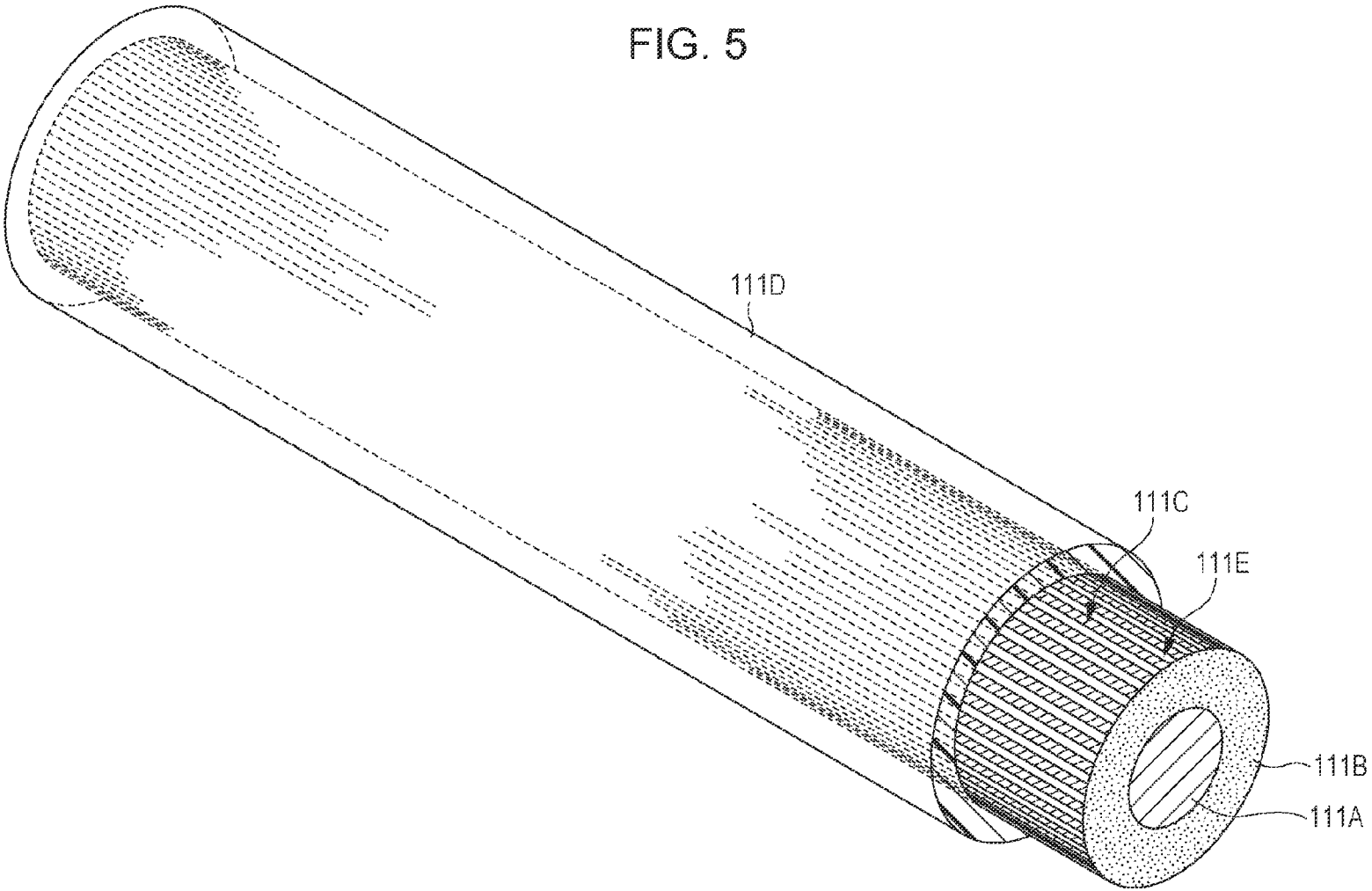
FIG. 5 is a perspective view of the pressing roller illustrated in FIG. 4, with an adhesive layer thereof partially exposed.

FIG. 4 is a sectional view of the pressing roller 111 according to this exemplary embodiment. FIG. 5 is a perspective view showing an adhesive layer of the pressing roller 111 illustrated in FIG. 4.

The pressing roller 111 includes the core 111A, the elastic layer 111B, the release layer 111D, and an adhesive layer 111C. The elastic layer 111B is formed on the outer surface of the core 111A. The release layer 111D is formed on the outer surface of the elastic layer 111B. The adhesive layer 111C bonds together the elastic layer 111B and the release layer 111D.

The core 111A corresponds to an example of a cylindrical or substantially cylindrical substrate in this exemplary embodiment. The elastic layer 111B corresponds to an example of a first layer that contains bubbles and that is elastic in this exemplary embodiment. The release layer 111D corresponds to an example of a second layer in this exemplary embodiment. The adhesive layer 111C corresponds to an example of an adhesive layer in this exemplary embodiment.

As illustrated in FIG. 5, the pressing roller 111 has adhesion-free unbonded regions 111E between the elastic layer 111B and the release layer 111D. The unbonded regions 111E extend to at least one end of the pressing roller 111 in the axial direction. Specifically, the unbonded regions 111E are gaps, where no adhesive is applied, extending to at least one end of the pressing roller 111 in the axial direction. As illustrated in FIG. 5, the unbonded regions 111E may extend from one end to the other end of the pressing roller 111 in the axial direction.

Core

The core 111A is, for example, a nickel-plated iron cylinder having a diameter of 18 mm.

Elastic Layer

The elastic layer 111B is formed of, for example, foamed silicone rubber, foamed fluorocarbon rubber, or foamed fluorosilicone rubber. Examples of available foaming agents include azobisisobutyronitrile (AIBN), sodium hydrogen carbonate, ammonium carbonate, and diazoaminobenzene.

The elastic layer 111B may be formed of a foamed rubber prepared by adding a foaming agent to an unvulcanized rubber, such as silicone rubber, and foaming the rubber with heat. Alternatively, the elastic layer 111B may be formed of a self-foaming rubber, such as a two-component liquid silicone rubber, which generates a crosslinking gas.

The elastic layer 111B has numerous bubbles dispersed therein. The bubbles are filled with a gas such as air. The foaming rate of the elastic layer 111B may be from 120% to 250%.

The elastic layer 111B completely covers the outer surface of the core 111A. The elastic layer 111B preferably has a thickness of from 2 to 20 mm, more preferably from 3 to 10 mm.

The elastic layer 111B may have cuts connected to the bubbles and the unbonded regions 111E (adhesive-free areas extending to at least one end thereof in the axial direction between the elastic layer 111B and the release layer 111D), described later. The cuts may have such a shape that they are closed normally and are opened as the air in the bubbles is expanded by heat applied to the elastic layer 111B. The cuts may have any shape that allows them to connect the bubbles to the unbonded regions 111E. For example, the cuts may extend in the radial direction or in a direction inclined with respect to the radial direction.

For example, the cuts may be formed in the elastic layer 111B on the core 111A in the radial direction or in a direction inclined with respect to the radial direction using a tool such as a needle or cutter.

In this exemplary embodiment, the elastic layer 111B is formed of foamed silicone rubber and has a thickness of 5 mm and a hardness of 60° (Asker-C hardness)

Release Layer

The release layer 111D is formed of a material with high releasability and heat resistance, such as fluorocarbon resin (e.g., PFA, PTFE, or FEP), silicone resin, silicone rubber, fluorocarbon rubber, or fluorinated polyimide.

The release layer 111D completely covers the outer surface of the elastic layer 111B. The release layer 111D preferably has a thickness of from 10 to 200 μm, more preferably from 20 to 100 μm.

In this exemplary embodiment, the release layer 111D is formed of PFA and has a thickness of 30 μm.

Adhesive Layer

The adhesive layer 111C bonds together the elastic layer 111B and the release layer 111D. Examples of adhesives used for the adhesive layer 111C include moisture-curing silicone adhesives, addition-curing silicone adhesives, fluorocarbon rubber adhesives, and epoxy adhesives. The adhesive layer 111C may be formed of an adhesive having the property of not dropping when applied to the elastic layer 111B (thixotropy).

The adhesive layer 111C preferably has a thickness of from 1 to 300 μm, more preferably from 3 to 100 μm.

In this exemplary embodiment, the adhesive layer 111C is formed of an addition-curing silicone rubber adhesive (available from Dow Corning Toray Co., Ltd. under the trade name SE 1750) and has a thickness of 15 μm.

Unbonded Region

In this exemplary embodiment, the adhesive layer 111C, which bonds together the elastic layer 111B and the release layer 111D, does not completely cover the outer surface of the elastic layer 111B; the pressing roller 111 has the adhesion-free unbonded regions 111E. As illustrated in FIG. 5, the adhesion-free unbonded regions 111E extend to at least one end of the pressing roller 111 in the axial direction (or may extend from one end to the other end of the pressing roller 111 in the axial direction) between the elastic layer 111B and the release layer 111D. The adhesive layer 111C may cover the outer surface of the elastic layer 111B at least partially in the circumferential direction along the entire axis of the pressing roller 111.

The unbonded regions 111E (gaps) illustrated in FIG. 5, which extend parallel to the axial direction, preferably have a gap width of from 0.1 to 10 mm, more preferably from 0.5 to 5 mm.

The unbonded regions 111E preferably have a gap-to-gap spacing of from 0.1 to 10 mm, more preferably from 0.5 to 5 mm. All the gaps may be formed at a regular spacing.

In this exemplary embodiment, the unbonded regions 111E have a gap width of 2 mm and a gap-to-gap spacing of 2 mm.

The unbonded regions 111E (gaps) illustrated in FIG. 5, which extend parallel to the axial direction, may be formed, for example, by the following methods.

A first method involves dipping the elastic layer 111B formed on the core 111A in the adhesive for forming the adhesive layer 111C using a mask covering the regions that are not to be coated.

A second method involves providing an adhesive sheet coated with the adhesive in a predetermined pattern and transferring the adhesive from the adhesive sheet to the elastic layer 111B formed on the core 111A.

A third method involves applying the adhesive to the outer surface of the elastic layer 111B in a direction parallel to the axial direction of the core 111A. By repeating this operation, the adhesive is applied to the entire outer surface of the elastic layer 111B at a predetermined spacing. This method uses an adhesive-ejecting apparatus including a nozzle that ejects the adhesive, a moving unit that moves in a direction parallel to the axial direction, and a rotating unit that rotates the core 111A having the elastic layer 111B in the circumferential direction. The adhesive-ejecting apparatus ejects the adhesive while moving the core 111A having the elastic layer 111B in the axial direction.

A fourth method involves applying the adhesive to the outer surface of the elastic layer 111B in a direction parallel to the axial direction. This method uses an adhesive-ejecting apparatus including the same number of nozzles as the regions to be coated with the adhesive. The nozzles are arranged in a circumferential pattern whose diameter is slightly larger than the outer diameter of the elastic layer 111B. The adhesive-ejecting apparatus ejects the adhesive while moving the nozzles in the axial direction of the core 111A, or while moving the core 111A having the elastic layer 111B in the axial direction without moving the nozzles.

A fifth method involves applying the adhesive to the outer surface of a smooth, cylindrical substrate in the axial direction by the third or fourth method and transferring the adhesive to the outer surface of the elastic layer 111B by rotating and pressing the substrate against the elastic layer 111B.

A sixth method involves forming grooves (ribs and grooves) on the outer surface of a cylindrical substrate in the axial direction, applying the adhesive only to the grooves (not to the ribs), and transferring the adhesive to the outer surface of the elastic layer 111B by rotating and pressing the substrate against the elastic layer 111B. Alternatively, the adhesive may be applied to the entire surface and be removed only from the ribs.

Although the unbonded regions 111E illustrated in FIG. 5 extend parallel to the axial direction from one end to the other end of the pressing roller 111 in the axial direction, other unbonded regions may be provided in this exemplary embodiment.

Figure 6:
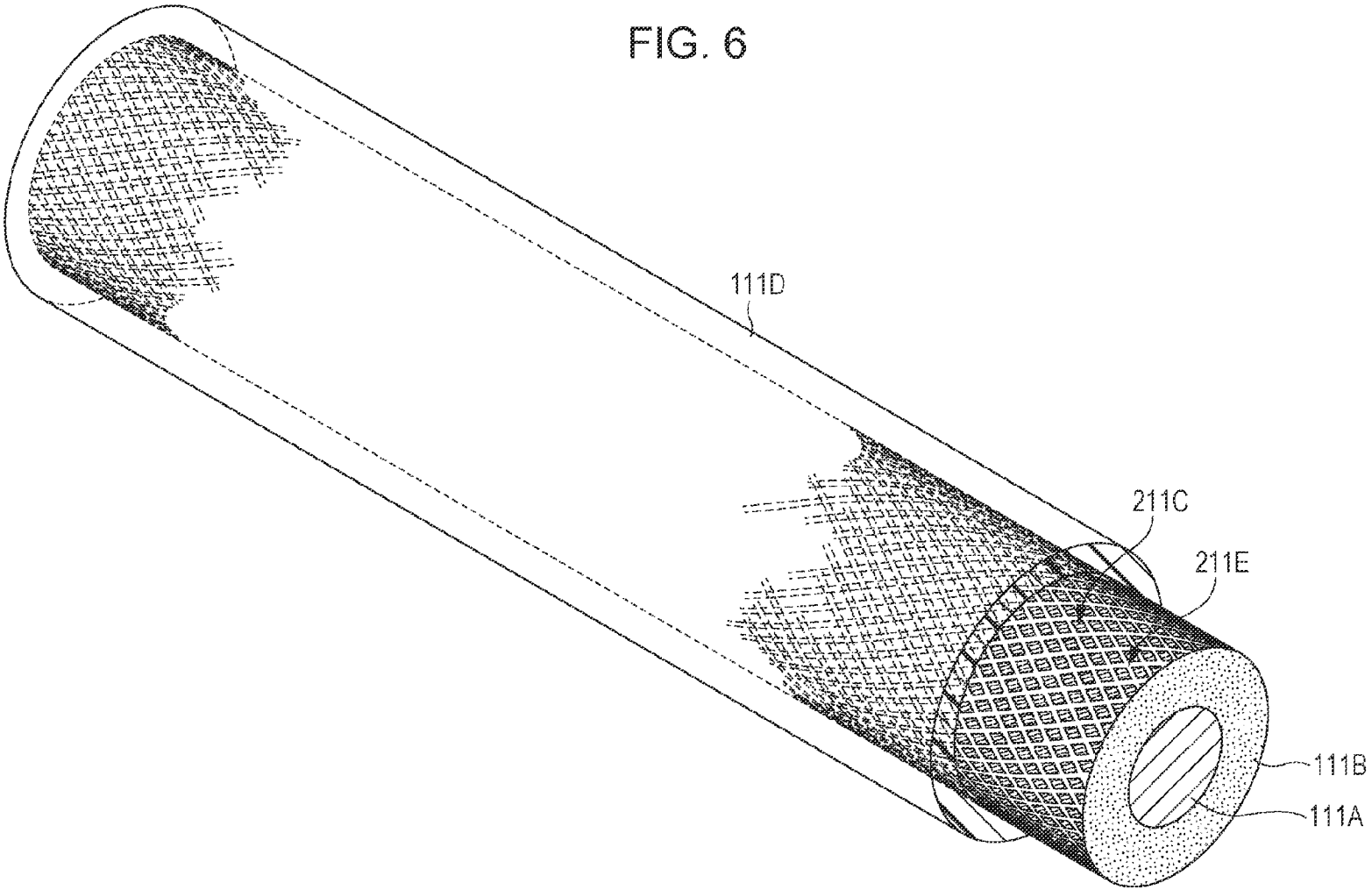
FIG. 6 is a perspective view of another pressing roller according to the exemplary embodiment, with an adhesive layer thereof partially exposed.

For example, as illustrated in FIG. 6, an unbonded region 211E may be provided. The unbonded region 211E forms gaps extending from one end to the other end of the pressing roller 111 in the axial direction and crossing each other in a grid pattern. The unbonded region 211E illustrated in FIG. 6, which forms gaps extending from one end to the other end of the pressing roller 111 in the axial direction and crossing each other in a grid pattern, may have a gap width and a gap-to-gap spacing similar to those of the gaps illustrated in FIG. 5, which extend parallel to the axial direction.

The gaps illustrated in FIG. 6, which extend from one end to the other end of the pressing roller 111 in the axial direction and which cross each other in a grid pattern, may be formed, for example, by the second method discussed above. Another method involves forming the grid grooves (ribs and grooves) illustrated in FIG. 6 on the surface of a cylindrical substrate, applying the adhesive only to the grooves (not to the ribs), and transferring the adhesive to the outer surface of the elastic layer 111B by rotating and pressing the substrate against the elastic layer 111B. Alternatively, the adhesive may be applied to the entire surface and be removed only from the ribs.

Other examples of unbonded regions include an unbonded region extending spirally from one end to the other end of the pressing roller 111 in the axial direction and an unbonded region formed between dots of a dot pattern of the adhesive.

The percentage ((b)/(a)×100) of the total area (b) of the adhesive coating to the total area (a) of the outer surface of the elastic layer 111B is preferably 30% to 90%, more preferably 40% to 70%.

Method for Manufacturing Pressing Member

The pressing roller 111 is manufactured, for example, as follows. A layer of elastic material is first formed on a cylindrical or substantially cylindrical core 111A. The layer is ground to the desired shape using a grinder to form the elastic layer 111B. Cuts are formed in the elastic layer 111B using, for example, a needle. An adhesive is applied to the elastic layer 111B, for example, by any of the first to sixth methods discussed above. The core 111A having the elastic layer 111B is inserted into a tube, for forming a release layer, whose diameter is smaller than the outer diameter of the elastic layer 111B, with the tube being expanded. The tube is fitted around the elastic layer 111B by allowing the tube to return to its original size. Finally, the adhesive is cured.

Operation

As discussed above, a pressing member for fixing according to this exemplary embodiment includes a cylindrical or substantially cylindrical substrate; a first layer that is disposed on an outer surface of the substrate, that contains bubbles, and that is elastic; a second layer disposed on an outer surface of the first layer; and an adhesive layer bonding together the first layer and the second layer. The pressing member has an adhesive-free unbonded region between the first layer and the second layer. The unbonded region extends to at least one end of the pressing member in an axial direction.

During the operation of a fixing device, a pressing member for fixing (hereinafter "pressing member") applied to the fixing device receives heat from a corresponding heat-fixing member. This heat thermally expands a first layer that is elastic, thus increasing the outer diameter of the pressing member. This thermal expansion is attributed to thermal expansion of the first layer itself and of the gas in the bubbles contained in the first layer.

As the atmospheric pressure rises, the thermally expanded gas in the bubbles travels through the walls of the bubbles and is finally released outside from the ends of the pressing member in the axial direction. However, it takes time for the gas in the bubbles located in the center of the pressing member in the axial direction to be released outside because the gas needs to travel a long distance to the ends of the pressing member in the axial direction. It is found that the outer diameter of the pressing member in the center thereof in the axial direction increases sharply immediately after the fixing device is operated and starts heating, and decreases gradually to its original diameter as the gas travels.

One approach to reducing the increase in the outer diameter of the pressing member during the operation of the fixing device is to arrange numerous through-holes extending axially through the first layer, which contains bubbles and which is elastic, in the circumferential direction. However, the through-holes extending axially through the first layer, which is elastic, decrease the pressure exerted by the portions of the first layer where the through-holes are formed in the contact area formed by pressing the pressing member against the heat-fixing member. This might cause uneven melting of toner and might therefore result in an uneven gloss in the fixed image. In addition, the first layer might crack easily because stress concentrates on the portions of the first layer where the through-holes are formed.

The pressing member according to this exemplary embodiment includes the adhesive layer bonding together the first layer, which contains bubbles and which is elastic, and the second layer and has the adhesive-free unbonded region between the first layer and the second layer. The unbonded region extends to at least one end of the pressing member in the axial direction. When heat applied to the pressing member thermally expands the gas in the bubbles contained in the first layer, the gas travels through the walls of the bubbles into the unbonded region. The gas may then easily travel through the unbonded region to the ends of the pressing member in the axial direction and be released outside. This may reduce the increase in the outer diameter of the pressing member.

In addition, no pressure decrease may occur at particular locations where the pressing member is pressed in the contact area formed by pressing the pressing member against the heat-fixing member of the fixing device. This may avoid uneven melting of toner and may therefore avoid an uneven gloss in the fixed image.

In addition, no stress may concentrate on particular portions of the first layer of the pressing member. This may avoid cracking of the first layer and may therefore provide high durability.

In this exemplary embodiment, the first layer may have a cut extending radially and connected to the bubbles and the unbonded region.

The cut, which is closed when no heat is applied to the first layer, is opened by thermal expansion when heat is applied to the first layer. The gas in the bubbles contained in the first layer may travel through the opened cut into the unbonded region between the first layer and the second layer. Thus, the gas may travel faster than through the walls of the bubbles. As a result, the first layer may allow the gas in the bubbles to be more smoothly released outside than a layer having no cut. This may more efficiently reduce the increase in the outer diameter of the pressing member.

In this exemplary embodiment, the unbonded region between the first layer and the substrate layer may extend from one end to the other end of the pressing member.

The unbonded region extending from one end to the other end of the pressing member may allow the gas in the bubbles to be more smoothly released outside than an unbonded region extending to only one end of the pressing member in the axial direction. This may more efficiently reduce the increase in the outer diameter of the pressing member.

Modifications

Whereas a pressing member for fixing, a fixing device, and an image-forming apparatus according to an exemplary embodiment have been described with reference to the drawings, they are not intended to be limiting.

For example, the adhesive layer 111C of the pressing roller 111 does not necessarily have to cover the outer surface of the elastic layer 111B at least partially in the circumferential direction along the entire axis of the pressing roller 111. Nevertheless, to efficiently prevent the release layer 111D from detaching from the elastic layer 111B, the adhesive layer 111C may cover the outer surface of the elastic layer 111B at least partially in the circumferential direction along the entire axis of the pressing roller 111.

The unbonded region between the elastic layer 111B and the release layer 111D extends to at least one end of the pressing roller 111 in the axial direction. The unbonded region may extend from the center to one end of the pressing roller 111 in the axial direction. Alternatively, the unbonded region may extend from one end to the other end of the pressing roller 111 in the axial direction.

Whereas the release layer 111D is disposed on the elastic layer 111B with the adhesive layer 111C therebetween in the foregoing exemplary embodiment, an intermediate layer may be disposed on the elastic layer 111B with the adhesive layer 111C therebetween, and the release layer 111D may be disposed on the outer surface of the intermediate layer.

Whereas the heat-fixing belt 110, which is pressed against the pressing roller 111 by the pressure member 113, has been described as an example of a heat-fixing member in the foregoing exemplary embodiment, the heat-fixing member is not limited thereto. For example, the heat-fixing member may be a heat-fixing roller.

Whereas paper is used as a recording medium in the foregoing exemplary embodiment, the recording medium is not limited thereto. For example, sheets for various purposes may be used. In addition, either one sheet or more than one sheets, as used for forming a laminated sheet, may be used.

Whereas a tandem color printer has been described as an example of an image-forming apparatus in the foregoing exemplary embodiment, the image-forming apparatus is not limited thereto. For example, the image-forming apparatus may be a monochrome printer including no intermediate transfer belt.

Whereas a printer has been described as an example of an image-forming apparatus in the foregoing exemplary embodiment, the image-forming apparatus is not limited thereto. For example, the image-forming apparatus may be a copier or facsimile that forms an image based on data acquired by an image reader.

EXPERIMENTAL EXAMPLE 1

Performance evaluations of a fixing device configured as above are shown below, although the following examples are not intended to be limiting.

In this experiment, the pressing roller 111 illustrated in FIG. 5 is pressed against the heat-fixing belt 110 at a load of 60 kgf in the manner as illustrated in FIG. 2.

Figure 7:
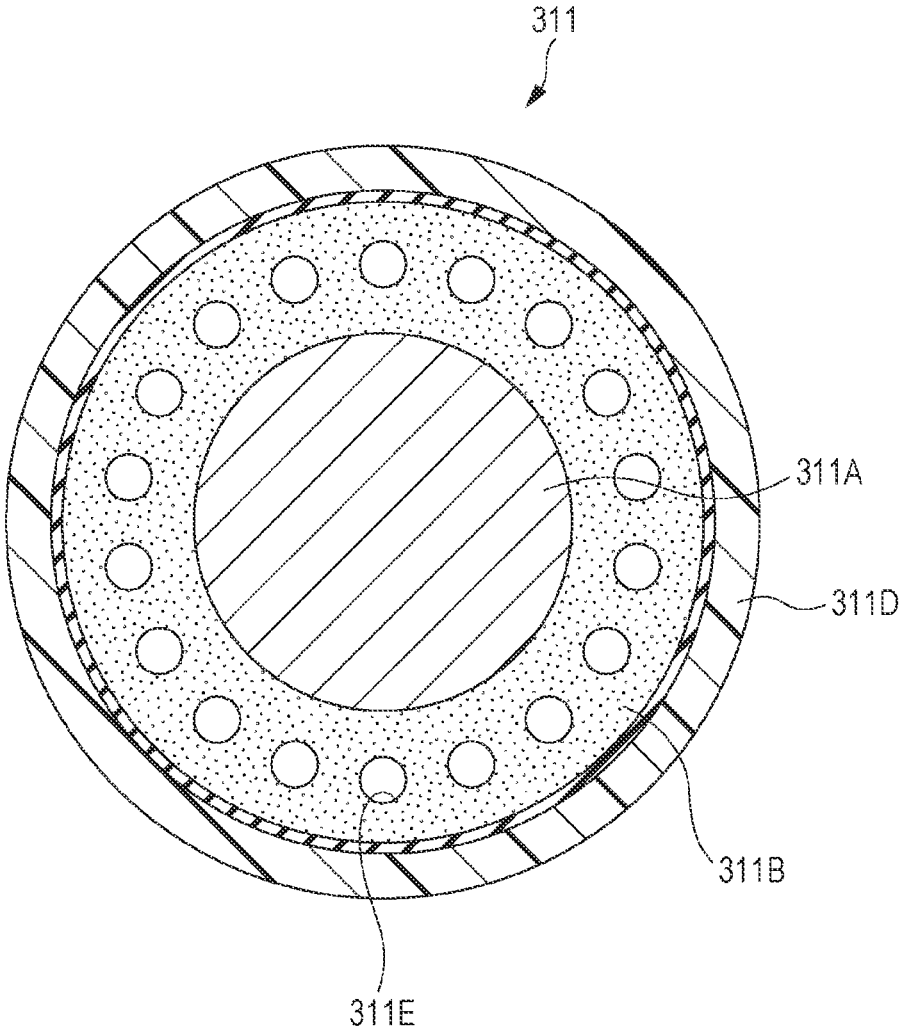
FIG. 7 RELATED ART
FIG. 7 is a sectional view of a pressing roller in the related art.

A pressing roller 311 illustrated in FIG. 7 is also provided as a pressing roller of Comparative Example 1. The pressing roller 311 includes a core 311A, an elastic layer 311B disposed on the outer surface of the core 311A, and a release layer 311D disposed on the outer surface of the elastic layer 311B. The release layer 111D has 18 through-holes 311E extending from one end to the other end of the pressing roller 311 in the axial direction. The through-holes 311E are cylindrical and have a diameter of 1 mm without heat from the heat-fixing belt 110. The through-holes 311E are arranged at a regular spacing in the circumferential direction. The through-holes 311E are located at a position 2.5 mm from the surface of the pressing roller 311 toward the center of the core 311A.

The pressing roller 111 illustrated in FIG. 5 according to the foregoing exemplary embodiment and the pressing roller 311 of Comparative Example 1 are mounted on fixing devices. These fixing devices are used to fix solid images having a toner density of 10 g/m$^2$ by rotating the pressing rollers at a peripheral velocity of 80 mm/s.

As a result, the image formed using the pressing roller 311 of Comparative Example 1 has a visible uneven gloss with streaks corresponding to the through-holes 311E of the elastic layer 311B. In contrast, the image formed using the pressing roller 111 according to the foregoing exemplary embodiment has no visible uneven gloss.

EXPERIMENTAL EXAMPLE 2

The next experiment examines a change in the outer diameter of a pressing roller due to thermal expansion.

This experiment compares the pressing roller 111 illustrated in FIG. 5 according to the foregoing exemplary embodiment, the pressing roller 311 of Comparative Example 1, and a pressing roller similar to the pressing roller 311 of Comparative Example 1 except that no through-holes are provided (Comparative Example 2).

The temperature of the outer surface of a cylindrical heat-fixing belt is raised to 170° C. by heating the inner surface thereof using a halogen lamp. The heat-fixing belt 110 is pressed against the pressing roller under examination while rotating the pressing roller at 60 rpm. The surface of the pressing roller is maintained at 170° C. The increase in the outer diameter of the pressing roller in the center thereof relative to the outer diameter at room temperature (25° C.) is measured using a laser diameter gauge.

As a result, the increase in the outer diameter of the pressing roller 111 according to the foregoing exemplary embodiment is 0.83 mm. The increase in the outer diameter of the pressing roller 311 of Comparative Example 1 is 0.85 mm. The increase in the outer diameter of the pressing roller of Comparative Example 2 is 1.7 mm.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A pressing member for fixing, comprising:

a substantially cylindrical substrate;

a first layer that is disposed on an outer surface of the substrate, contains bubbles and is elastic;

a second layer disposed on an outer surface of the first layer; and an adhesive layer bonding together the first layer and the second layer, the pressing member having an adhesive-free unbonded region between the first layer and the second layer, the unbonded region extending to at least one end of the pressing member in an axial direction.

2. The pressing member for fixing according to claim 1, wherein the adhesive layer covers the outer surface of the first layer at least partially in a circumferential direction along an entire axis of the pressing roller.

3. The pressing member for fixing according to claim 2, wherein the first layer has a cut connected to the bubbles and the unbonded region.

4. The pressing member for fixing according to claim 2, wherein the unbonded region extends from one end to another end of the pressing roller in the axial direction.

5. The pressing member for fixing according to claim 3, wherein the unbonded region extends from one end to another end of the pressing roller in the axial direction.

6. The pressing member for fixing according to claim 1, wherein the first layer has a cut connected to the bubbles and the unbonded region.

7. The pressing member for fixing according to claim 6, wherein the unbonded region extends from one end to another end of the pressing roller in the axial direction.

8. The pressing member for fixing according to claim 1, wherein the unbonded region extends from one end to another end of the pressing roller in the axial direction.

9. A fixing device comprising:

the pressing member according to claim 1;

a heating device; and a heat-fixing member that is heated by the heating device, that forms a contact area with the pressing member as the pressing member is pressed against the heat-fixing member, and that rotates while holding a recording medium having a toner image in the contact area and heats and presses the toner image to fix the toner image to the recording medium.

10. An image-forming apparatus comprising:

a toner-image forming section that forms a toner image and that transfers the toner image to a recording medium;

the fixing device according to claim 9; and a transport device that transports the recording medium having the toner image to the contact area between the heat-fixing member and the pressing member.

11. A substantially cylindrical pressing member for fixing, the cylindrical pressing member comprising:

a substrate;

a first layer that is over the substrate, elastic and contains bubbles;

a second layer over the first layer;

an adhesive region between the first layer and the second layer; and an adhesive-free region between the first layer and the second layer.

12. The cylindrical pressing member according to claim 11, wherein the adhesive region is adjacent to the adhesive-free region.

13. The cylindrical pressing member according to claim 12, wherein the adhesive region and the adhesive-free region extend parallel to one another.

14. The cylindrical pressing member according to claim 11, wherein the adhesive-free region is disposed in a grid pattern.

15. The cylindrical pressing member according to claim 14, wherein the adhesive region is disposed in gaps of the grid pattern.

16. The cylindrical pressing member according to claim 11, wherein the adhesive-free region extends to at least one end of the pressing member.

17. The cylindrical pressing member according to claim 11, wherein the adhesive-free region provides a pathway for gas in the bubbles to be released outside of the cylindrical pressing member.

18. A pressing member for fixing comprising:

a substantially cylindrical substrate;

an elastic layer that is over the substrate and contains gas bubbles;

a layer over the elastic layer; and an adhesive-free region between the elastic layer and the layer that forms a pathway for the gas bubbles to be released.

* * * * *